United States Patent [19]

Itoh et al.

[11] 4,184,644

[45] Jan. 22, 1980

[54] WINDING MACHINE

[75] Inventors: Fumikazu Itoh, Fujisawa; Mitsuo Sato, Yokohama; Nobu Kamita, Hitachi; Takashi Kobayashi, Fujisawa; Noboru Sugimoto, Yokosuka, all of Japan

[73] Assignee: Hitachi, Ltd., Japan

[21] Appl. No.: 937,810

[22] Filed: Aug. 29, 1978

[30] Foreign Application Priority Data

Sep. 2, 1977 [JP] Japan ..... 52-104961

[51] Int. Cl.[2] ..... H01F 41/08

[52] U.S. Cl. ..... 242/4 B

[58] Field of Search ..... 242/4 B, 4 R, 4 BE; 29/732, 605, 596

[56] References Cited

U.S. PATENT DOCUMENTS 2,387,570 10/1945 Ewaldson ..... 242/4 B

FOREIGN PATENT DOCUMENTS 770545 3/1957 United Kingdom ..... 242/4 B

*Primary Examiner*—Billy S. Taylor

*Attorney, Agent, or Firm*—Craig and Antonelli

[57] ABSTRACT

A coil-winding machine is disclosed in which an annular member on which wire is to be wound is inserted into a traveling ring and a shuttle and held in position. A predetermined length of wire is stored in the shuttle. The trialing end of the wire stored in the shuttle is fixed on the annular member. The shuttle is rotated in the direction of storage, while at the same time rotating the traveling ring in the direction of storage by the tension of the wire or a turning effort transmitted from a driving system, thus winding the wire on the annular member in the direction of storage. After forming a cross-over wire, the wire is fixed on the annular member. The traveling ring is rotated in the direction opposite to that of storage. At the same time, the shuttle is rotated following the traveling ring with brake applied to the shuttle, or a turning effort in the direction of storage is transmitted to the shuttle through a clutch adapted to slip in response to a torque more than a setting, so that the required tension is applied to the wire, thus winding the wire on the annular member in the direction opposite to that of storage. In this way, the wire is wound in different directions in one process.

4 Claims, 10 Drawing Figures

WINDING MACHINE

FIELD OF THE INVENTION

This invention relates to a winding machine for winding a wire on an annular member in different directions alternately by use of a shuttle for storing the wire and a traveling ring for winding the wire on the annular member.

DESCRIPTION OF THE PRIOR ART

A motor of axial space type has been developed, in which a conductive wire is wound on an annular core in different directions alternately at predetermined intervals, thereby forming a stator, and a pair of disc-shaped magnets are disposed in spaced relation with the ends of the stator and coupled with each other by a shaft passing through the center of the stator, thereby forming a rotor.

The wire is wound on the above-mentioned stator by means of a winding machine such as disclosed in U.S. Pat. No. 2,444,126 entitled "Ring Winding Machine".

The winding machine of that type comprises a traveling ring rotated by a driving system for winding the wire on an annular member, and a shuttle for storing a wire of a predetermined length. A wire guiding element for guiding the wire is integrally secured to the traveling ring. The annular member is crossed with the traveling ring and the shuttle and held by a predetermined holding device (such as disclosed by U.S. Pat. No. 3,383,059). The shuttle is rotated in a predetermined direction (the direction of storage), thus winding and storing the required length of wire on the shuttle. The traveling end of the wire is fixed on the annular member through a slot formed in the wire guiding element. A brake is brought into contact with the shuttle, and the traveling ring is rotated in the direction of winding (the direction opposite to the direction of storage) by the driving system. At the same time, the holding device rotates the annular member in reciprocating movement by a predetermined angle about the axis of the annular member, thus winding the wire on the annular member by the required number of turns.

The above described winding machine is effective in the case where the wire is wound on the annular member in the same direction. However, in view of the fact that the traveling ring is rotated by the driving system and the tension of the wire generated by the rotation of the traveling ring is absorbed by the shuttle subjected to a predetermined load by the braking operation (in other words, the shuttle is stopped when the wire slackens, and the shuttle follows the traveling ring by the tension of the wire when the wire is being reeled off the shuttle), it is impossible to wind the wire in different directions in one process by forward and reverse rotations of the traveling ring.

In the case where a wire is wound on an annular core in different directions at predetermined intervals alternately such as in the above-mentioned motor of axial space type, therefore, three steps are taken. In the first step, the wire is wound in one direction; In the second step, the wire is wound in the direction opposite to that in the first step; In the third step, the ends of the wires wound in the first and second steps are connected to each other. This method of fabricating the stator is low in workability and also, due to need of connecting the wires wound in two steps, a plurality of crossover wires extend along the outer periphery of the core, thus complicating the appearance.

SUMMARY OF THE INVENTION

Accordingly, it is an object of the present invention to provide a winding machine capable of winding a wire on an annular member in different directions alternately in one process.

Another object of the invention is to provide a winding machine in which the tension of the wire is capable of being adjusted in winding the wire on the annular member in different directions alternately.

In order to achieve the above-mentioned objects, according to the present invention, there is provided a winding machine comprising a traveling ring for winding the wire on the annular member, a shuttle for storing the wire, two separate driving systems for rotating the traveling ring and the shuttle separately in the desired directions respectively, thereby winding the wire on the annual member in different directions alternately.

DESCRIPTION OF THE PREFERRED EMBODIMENTS

The embodiments of the present invention will be described below with reference to the accompanying drawings.

Figure 1:
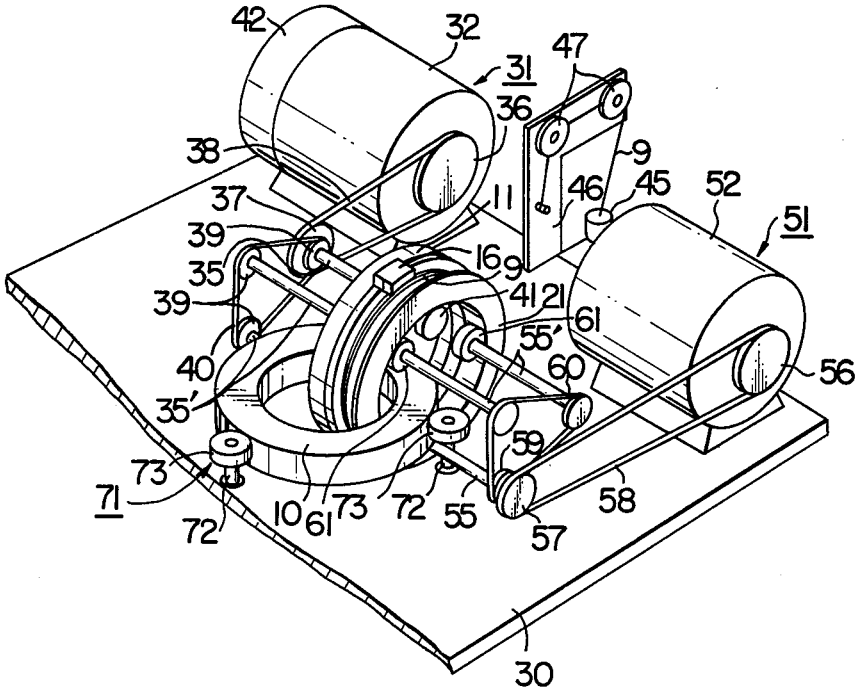
FIG. 1 is a perspective view showing essential parts of a winding machine according to a first embodiment of the present invention.
Figure 3:
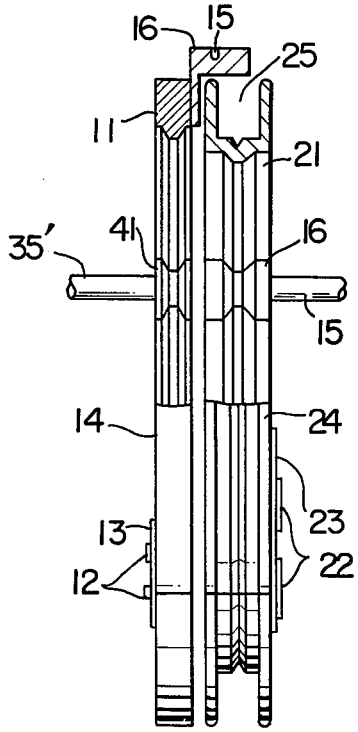
FIG. 3 is a partially cross-sectional view of the traveling ring and the shuttle used in the present invention.
Figure 2:
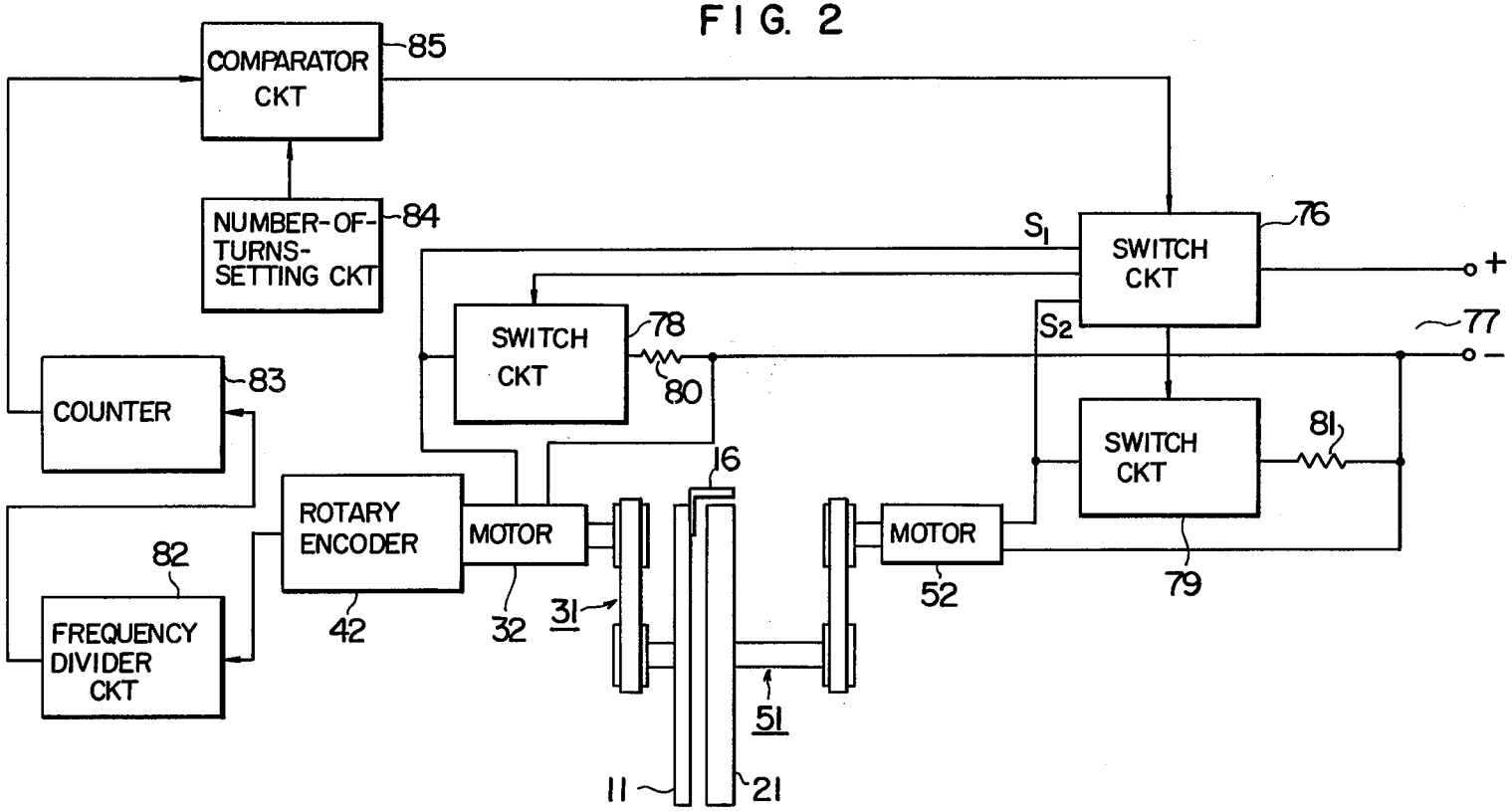
FIG. 2 is a block diagram showing a driving system of the winding machine shown in FIG. 1.

A first embodiment of the present invention is shown in FIGS. 1 to 3. A traveling ring 11 has an opening through which a core 10 is adapted to be inserted. In the opening, a segment 14 is detachably disposed with being supported by means of pins 12 and a coupling member 13. A guide member 16 with a groove 15 for guiding a wire 9 is secured on the traveling ring 11. A shuttle 21 has an opening through which the core 10 is adapted to be inserted, in which opening a segment 24 is detachably disposed being supported by means of pins 22 and a coupling member 23. A groove 25 for storing the wire 9 is formed in the outer periphery of the shuttle 21. The segments 14 and 24 are detached from the traveling ring 11 and the shuttle 21 respectively when the core 10 is inserted into or removed from the traveling ring 11 and the shuttle 21, and restored to the original position fixedly upon insertion or removal of the core 10. A first driving system 31 includes a DC motor 32 (hereinafter referred to only as the motor 32) secured on the base 30, three shafts 35, 35' each rotatably supported in predetermined positions by a support member (not shown) through a bearing, a belt 38 suspended between a pulley 36 secured to the rotary shaft of the motor 32 and a pulley 37 secured to an end of the shaft 35 for transmitting the turning effort of the motor 32 to the shaft 35, a belt 40 suspended among pulleys 39 secured to the ends of the three shafts 35, 35' for transmitting the turning effort from the shaft 35 to the shafts 35', and roller 41 secured to the other ends of the shafts 35, 35' for supporting the traveling ring 11 on the internal surface thereof and transmitting the turning effort of the motor 32 to the traveling ring 11. The motor 32 has a rotary encoder 42 for generating a pulse in synchronism with the rotation of the motor 32. The wire 9 is pulled out of the supply case 45, hung on rollers 47 rotatably supported on a support member 46, and engaged with the support member 46. A second driving system 51 includes a DC motor 52 (hereinafter referred to only as the motor 52) secured on the base 30, three shafts 55, 55' each supported rotatably in predetermined positions on a support member (not shown) through a bearing, a belt 58 suspended between a pulley 56 fixed to the rotary shaft of the motor 52 and a pulley 57 fixed to an end of the shaft 55 for transmitting the turning effort of the motor 52 to the shaft 55, a belt 60 suspended among the pulleys 59 secured to the ends of the shafts 55, 55' for transmitting the turning effort from the shaft 55 to shafts 55', and rollers 61 secured to the other ends of the shafts 55, 55' for supporting the shuttle 21 on the internal surface thereof in spaced relation with the traveling ring 11 in such a manner that the axis of the shuttle 21 is aligned with that of the traveling ring 11 and the turning effort is transmitted from the motor 52 to the shuttle 21. A holding device 71 has a body (not shown) disposed under the base 30, three shafts 72 projected through the base 30 from the body, and rollers 73 secured to the tops of the shafts 72. The holding device 71 holds the core 10 at the winding position of the wire 9 in such a manner that a part of the core 10 crosses the axes of the traveling ring 11 and the shuttle 21 and that the core 10 rotates in a reciprocating movement by a predetermined angle about the axis thereof in synchronism with the rotation of the traveling ring 11 and the shuttle 21. A switch circuit 76 is inserted on the positive side of a DC power supply 77 and is adapted to be manually closed or opened or automatically opened. When automatically opened, the switch circuit 76 is changed over from the contact S1 to S2 or vice versa. When the contacts are switched over, the switch circuit 76 applies a closing or opening signal to switch circuits 78 and 79 connected in parallel to the motors 32 and 52. Resistors 80 and 81 are connected in series with the switch circuit 78 and 79. The rotary encoder 42 is connected with a frequency divider circuit 82 whereby the number of the pulses generated by the rotary encoder 42 is converted into another number easy to control. A counter 83 is connected to the frequency divider circuit 82 for counting the pulses applied from the frequency divider circuit 82. The number of turns of the winding to be wound on each part of the core is set in a number-of-turns-setting circuit 84. A comparator circuit 85 is connected to the counter 83 and the number-of-turns-setting circuit 84 for applying an opening signal to the switch circuit 76 when the number of turns set in the number-of-turns-setting circuit 84 coincides with that counted by the counter 83.

In this arrangement, the core 10 is inserted into the openings of the traveling ring 11 and shuttle 21, and held by the rollers 73. The segments 14 and 24 are secured, and then the end of the wire 9 which has engaged with the support member 46 is secured to the shuttle 21. Next, the switch circuit 76 is changed over to the contact S2, thus closing the switch 76. At the same time, the switch circuit 76 applies a closing signal to the switch circuit 78 and an opening signal to the switch circuit 79, thereby closing and opening the switch circuits 78 and 79 respectively. When the switch circuit 76 is closed, DC current is applied to the motor 52, so that the motor 52 rotates in a predetermined direction for storage of the wire in the shuttle (hereinafter referred to merely as the direction of storage) and rotates the shuttle 21 in the direction of storage, thus storing the wire 9 in the groove 25. Upon completion of storage of a predetermined amount of the wire, the switch circuit 76 is opened and the motor 52 stops. Then, the wire 9 is cut off between the shuttle 21 and the rollers 47. The end of the wire 9 on the rollers 47 side is engaged with the support member 46, while the end of the wire 9 on the shuttle 21 side is fastened to the core 10 through the groove 15 of the guide member 16 fixed on the traveling ring 11 and through the space between the traveling ring 11 and the shuttle 21. Under this condition, the shuttle 21 is turned two or three rotations in the direction of storage, so that the wire 9 is wound two or three turns on the core 10 and the end thereof is securely fixed to the core 10. Then, the switch circuit 76 is closed, thereby rotating the motor 52 in the direction of storage. The turning effort of the motor 52 is transmitted to the shuttle 21. The shuttle 21 is rotated in the direction of storage, thus winding the wire 9 on the core 10 in the direction of storage. In this process, the tension of the wire 9 generated by the rotation of the shuttle 21 causes the traveling ring 11 to rotate in the direction of storage following the shuttle 21. As a result, the rotation of the traveling ring 11 is transmitted to the motor 32, thus rotating the same. Therefore, the motor 32 acts as a generator. Since the switch circuit 78 is closed, electric power generated by the motor 32 is converted into heat and consumed by the resistor 80. The motor 32 thus functions as a brake for the traveling ring 11. With the rotation of the motor 32, the rotary encoder 42 generates pulses of the number corresponding to the revolution number of the motor 32. These pulses are changed in number by the frequency divider circuit 82 and counter by the counter 83. When the number of the pulses counted by the counter 83 coincides with that of the number of turns of winding set in the number-of-turns-setting circuit 84, the comparator circuit 85 generates a winding-completion signal which is applied to the switch circuit 76. In response to the winding-completion signal, the switch circuit 76 opens and cuts off the current which has been applied to the motor 52, and the contact is changed over from S2 to S1. Thus, the opening signal is applied to the switch circuit 78, and the closing signal to the switch circuit 79, thus opening and closing the switch circuits 78 and 79 respectively. Then, the core 10 is rotated by a predetermined angle, so that the crossover wire is formed. Next, the traveling ring 11 is turned two or three rotations in the direction opposite to that of storage, and the wire 9 is wound two or three turns on the core 10 and fixed securely. Under this condition, the switch circuit 76 is closed, with the result that the motor 32 is impressed with DC current and rotated in the direction opposite to that of storage. The turning effort of the motor 32 is transmitted to the traveling ring 11, so that the traveling ring 11 is rotated in the direction opposite to that of storage, thus winding the wire 9 on the core 10 in the direction opposite to that of storage. In this process, tension is generated in the wire 9 by the rotation of the traveling ring 11 and pulls the shuttle 21, thus rotating it in the direction opposite to that of storage following the traveling ring 11. The rotation of the shuttle 21 is transmitted to the motor 52, so that the motor 52 is rotated in the direction opposite to that of storage. Thus, the motor 52 acts as a generator and generates electric power proportional to the rotational speed thereof. Since the switch circuit 79 is closed, power generated by the motor 52 is converted into heat and consumed by the resistor 81. The turning effort of the motor 32 is converted into pulses by the rotary encoder 42. When the predetermined number of turns of winding is reached, in a manner similar to that already described, the switch circuit 76 is opened. The contact of the switch circuit 76 is changed over from S1 to S2, thereby closing and opening the switch circuits 78 and 79 respectively.

The above-mentioned operations are repeated appropriately thereby to accomplish the desired winding.

Figure 4:
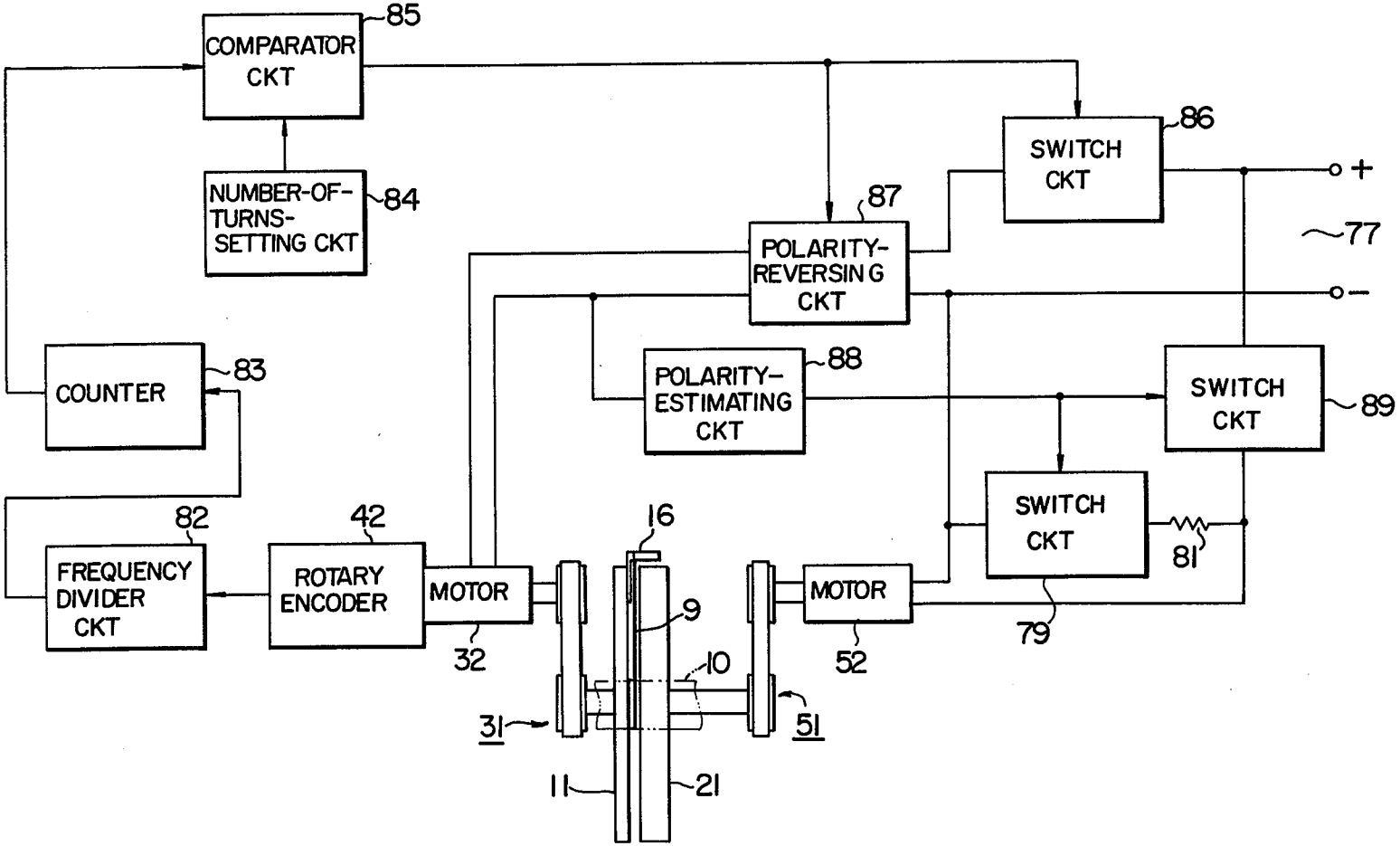
FIG. 4 is a block diagram showing a driving system for a winding machine according to a second embodiment of the present invention.
Figure 5A:
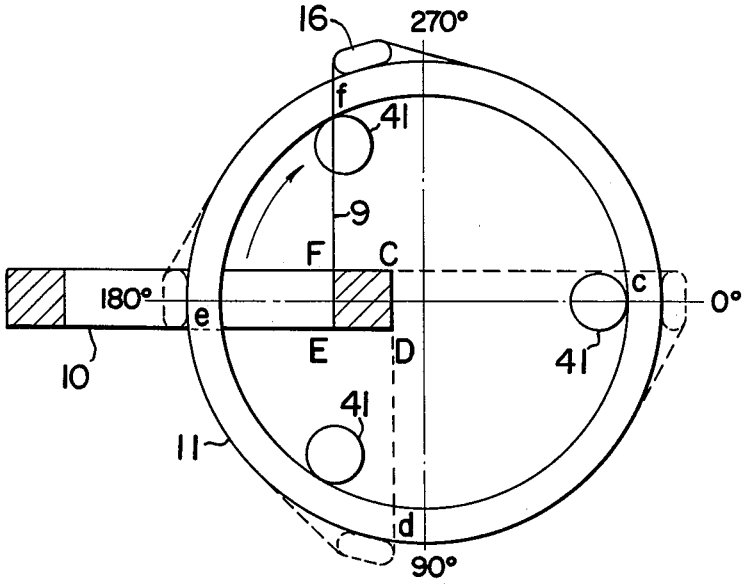
FIG. 5*a* is a view showing the step of winding in the clockwise direction.
Figure 5B:
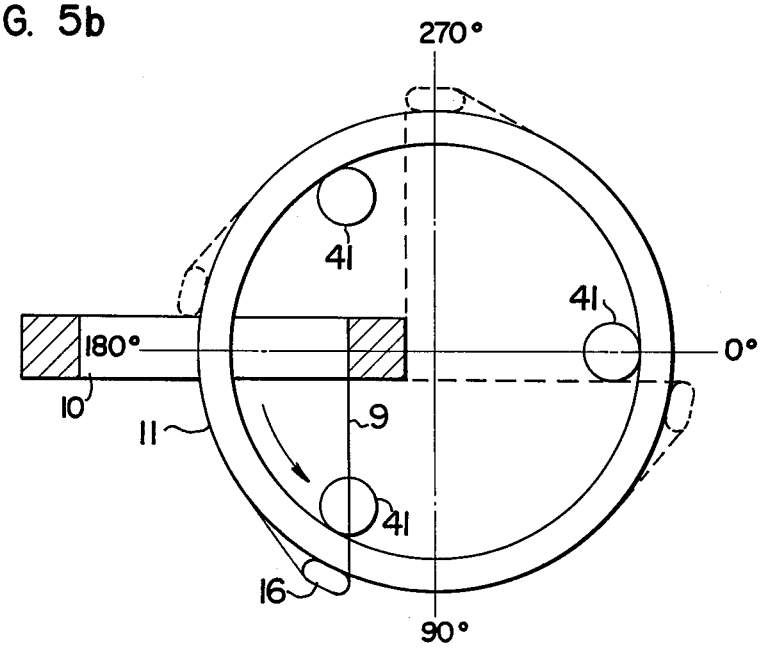
FIG. 5*b* is a view showing the step of winding in the counterclockwise direction.
Figure 6:
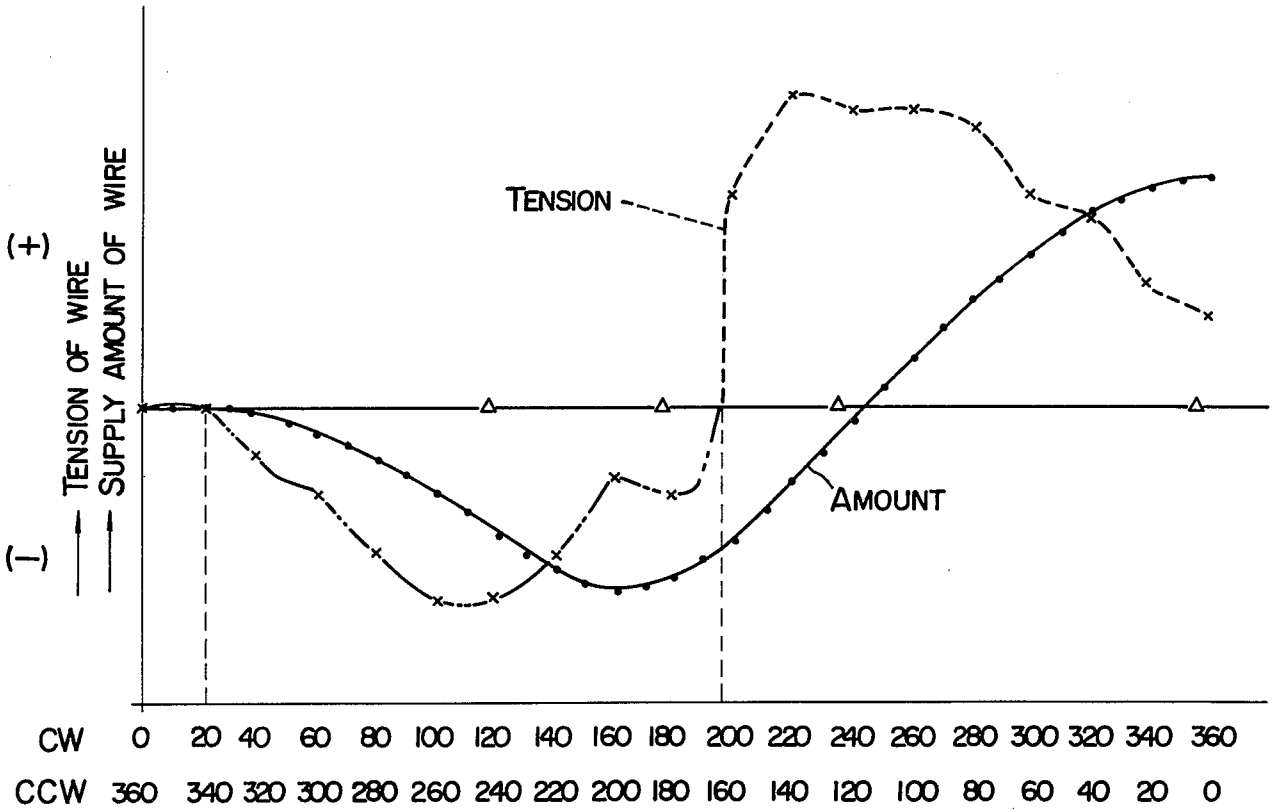
FIG. 6 is a graph showing a curve of variation of the amount of a wire supplied from a shuttle as related to the tension applied to the wire.

A second embodiment of the present invention is shown in FIGS. 4 to 6. In this embodiment, even when the core 10 is located in spaced relation with the axes of the traveling ring 11 and the shuttle 21 at the winding position of the wire 9 as shown in FIGS. 5*a* and 5*b*, the winding operation in alternately different directions is made possible in one process as in the preceding embodiment.

In the drawings under consideration, a switch circuit 86 is inserted on the positive side of the DC power supply 77 and connected to the comparator circuit 85. The switch circuit 86 is so constructed as to be opened in response to a winding-completion signal applied from the comparator circuit 85 and closed manually. A polarity-reversing circuit 87 is inserted between the switch circuit 86 and the motor 32 and connected to the comparator circuit 85. In response to a winding-completion signal from the comparator circuit 85, the polarity-reversing circuit 87 reverses the polarity of the current supplied to the motor 32, thus reversing the rotation of the motor 32. A polarity-estimating circuit 88 estimates the polarity of the current applied to the motor 32. A switch circuit 89 is provided on the positive side of the DC power supply 77 and connected to the polarity-estimating circuit 88. When the current applied to the motor 52 is of such a polarity as to rotate the motor 52 in the direction of storage, the switch circuit 89 is closed by a signal applied from the polarity-estimating circuit 88. At the same time, the switch 79 is opened in response to the signal supplied from the polarity-estimating circuit 88. When the polarity is reversed, the switch circuit 89 is opened while the switch circuit 79 is closed. The operation of the remaining component elements are the same as those included in the first embodiment, which are denoted by the same numerals as in FIG. 2.

In the above-mentioned arrangement, the core 10 is crossed with the traveling ring 11 and the shuttle 21, and held by the holding device. After this, as in the first embodiment, the wire 9 is stored in the shuttle 21 and the end of the wire 9 is fixed on the core 10. Under this condition, the switch circuit 86 is closed, so that the motor 32 is rotated in the direction of storage and the traveling ring 11 is thus rotated in the direction of storage for performing the winding operation. In the process, the switch circuit 89 is closed by the signal from the polarity-estimating circuit 88, and therefore the motor 52 and hence the shuttle 21 are rotated in the direction of storage. The shuttle 21 thus always rotates in such a direction as to take up the wire 9, thereby absorbing the slackened condition which might otherwise occur in the wire. Further, in the case where the core 10 is held in spaced relation with the axes of the traveling ring 11 and the shuttle 21, a trouble is avoided which occurs when the wire is wound by rotating only the shuttle 21 in the direction of storage. This trouble is such that, when the angle of the wire 9 supplied from the shuttle 21 between the shuttle 21 and the guiding member 16 becomes equal to that between the guide member 16 and the winding position on the core 10, the force urging the traveling ring 11 in the direction parallel to the radius of the traveling ring 11 occurs, and thus the rotation of the traveling ring 11 is prevented, thereby making impossible the winding operation. According to this embodiment, such a trouble is avoided and the wire is capable of being wound in the direction of storage. Upon completion of the winding of the wire of the predetermined number of turns on the core 10, a winding-completion signal is generated from the comparator circuit 85 as in the preceding embodiment. The switch circuit 86 is opened, and the polarity of the current to be applied to the motor 32 is reversed by the polarity-reversing circuit 88. Further, the switch circuit 89 is opened, and the switch circuit 79 is closed. After the core 10 is rotated by a predetermined angle, the traveling ring 11 is rotated two or three turns in the direction opposite to that of storage. The wire 9 is securely fixed on the core 10, and the switch circuit 86 is closed. The motor 32 is rotated in the direction opposite to that of storage, so that the traveling ring 11 rotates in the direction opposite to that of storage, thus winding the wire on the core 10 in the direction opposite to that of storage. At the same time, as in the preceding embodiment, the shuttle 21 is rotated in the direction opposite to that of storage by the tension of the wire 9 supplied from the shuttle 21. However, since the axes of the shuttle 21 is spaced from the core 10, the shuttle 21 remains stationary because the wire is slackened when the tension of the wire 9 is zero. (The wire 9 slackens in the negative range of the solid curve of FIG. 6. This curve depends on the diameter of the traveling ring 11, and the outer diameter and the position of the core 11.) Also, when the wire 9 is being supplied from the shuttle 21, the shuttle 21 rotates following the traveling ring 11. At this time, the shuttle 21 rotates at a higher speed than the traveling ring 11 and rotates the motor 52 as in the preceding embodiment, so that electric power is generated in proportion to the revolution speed of the motor 52. Power generated by the motor 52 is applied to the resistor 81 through the switch circuit 79, and converted into heat and consumed by the resistor 81. Thus, the motor 52 functions as a brake for the shuttle 21 and prevents the shuttle 21 from rotating at an excessively high speed or rotating undesirably by inertia. The curve of dashed line in FIG. 6 shows an example of variation in the tension applied to the wire 9 being wound. As long as the wire is slackened as described above, the tension of the wire 9 is usually zero, but when the shuttle 21 is rotated in the direction of storage and thus the slack of the wire 9 is absorbed, the dashed curve as shown in FIG. 6 is obtained. The marks Δ in FIG. 6 represent the corners of the core 10 where the tension of the wire 9 is varied. The abscissa of FIG. 6 designates the rotational angle of the shuttle 21, in which CW shows clockwise and CCW shows counterclockwise.

Figure 7:
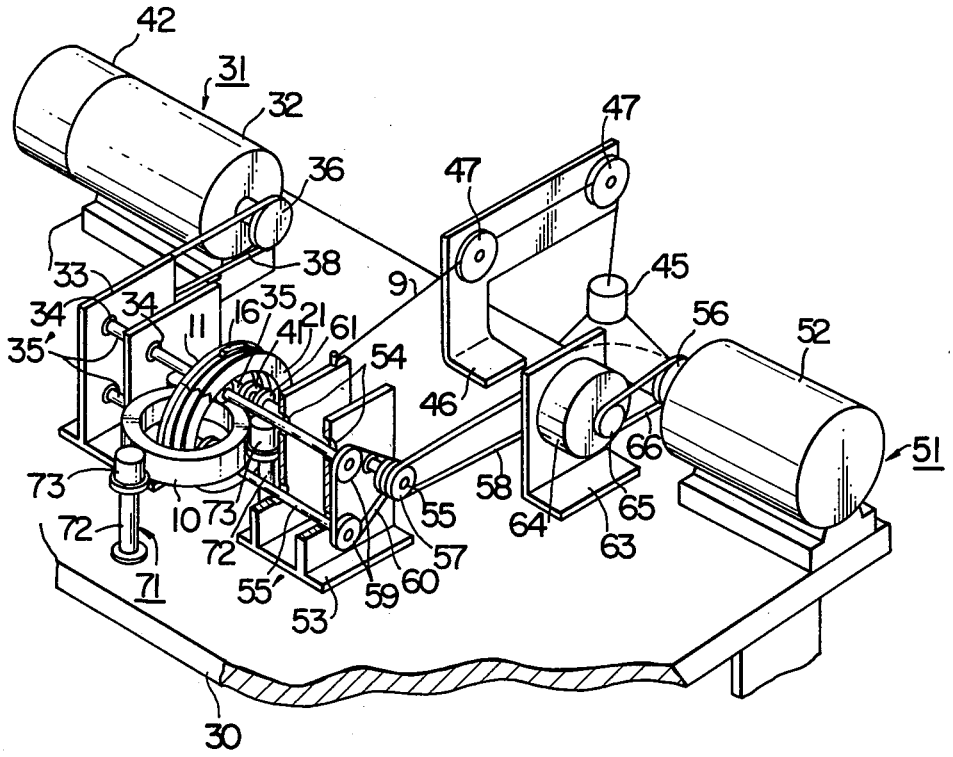
FIG. 7 is a perspective view of essential parts of a winding machine according to a third embodiment of the present invention.
Figure 8:
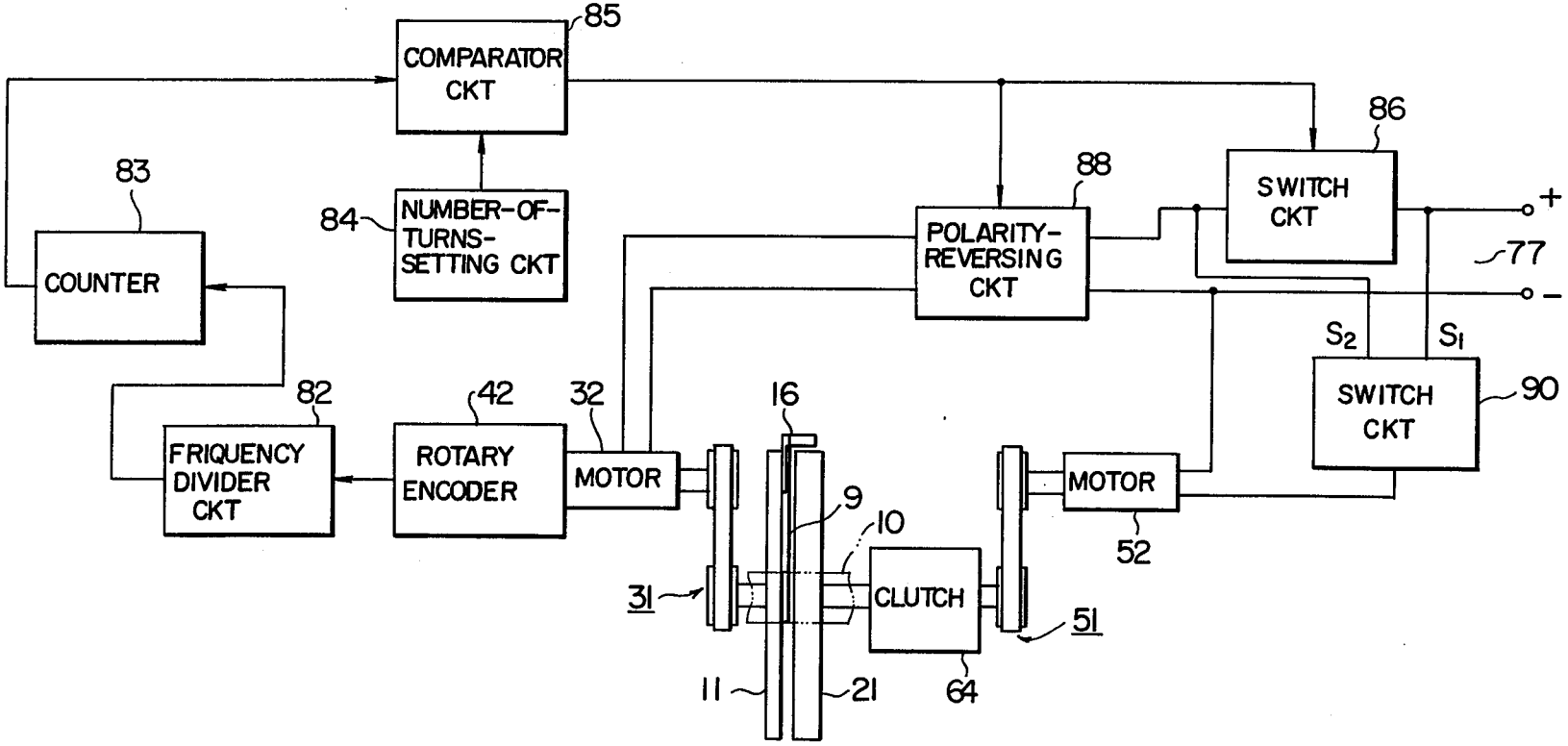
FIG. 8 is a block diagram showing a driving system of the winding machine shown in FIG. 7.

A third embodiment of the present invention is shown in FIGS. 7 and 8. This embodiment includes a friction clutch in the second driving system of the first and second embodiments. The friction clutch is made to slip when a torque more than a predetermined level is applied, thus reducing the variation in the tension applied to the wire 9.

In FIGS. 7 and 8, the shafts 35, 35' of the first driving system 31 are rotatably supported through the bearings 34 on the support member 33 fixed on the base 30. The shafts 55, 55' of the second driving system 51 are also rotatably supported through the bearings 54 on the support member 53 fixed on the base 30. The friction clutch 64 (hereinafter referred to merely as the clutch 64) is supported by the support member 63 between the pulley 64 and the pulley 57 of the second driving system 51. The belt 66 is hung between the pulley 65 on the driving side of the clutch 64 and the pulley 56. The belt 58 is hung between the pulley (not shown) on the driven side of the clutch 64 and the pulley 57. A switch circuit 90 is provided for performing a switching operation such that when the wire 9 is stored in the shuttle 21, only the shuttle 21 is rotated, and when the wire 9 is wound, the shuttle 21 and the traveling ring 11 are rotated at the same time. The contact S1 of the switch circuit 90 is connected to the positive side of the DC power supply 77, and the contact S2 to the positive side of the output of the switch circuit 86. The output of the switch circuit 90 is connected to the motor 52. Other component elements similar to those included in the first and second embodiments are denoted by the same numerals as in FIGS. 1 to 4.

In this arrangement, as in the second embodiment described above, the core 10 is inserted into the traveling ring 11 and the shuttle 21, and held by the rollers 73 of the holding device 71. After an end of the wire 9 is fixed on the shuttle 21, the switch circuit 90 is changed over to S1 side, thus supplying current to the motor 52. The motor 52 is then rotated in the direction of storage, thus rotating the shuttle 21 in the direction of storage through the clutch 64, so that the wire 9 is stored. Upon completion of storing the required amount of the wire, the switch 90 is switched to S2 side. Next, the end of the wire 9 stored in the shuttle 21 is fixed on the core 10, and the switch circuit 86 is closed, thus supplying DC current to the motors 32 and 52. The motors 32 and 52 are rotated in the direction of storage, with the result that both the traveling ring 11 and the shuttle 21 are rotated in the direction of storage thereby to perform the winding operation. In this process, the rotation of the shuttle 21 in the direction of storage provides tension to the wire 9. When the tension of the wire 9 exceeds a value corresponding to a sliding torque set in the clutch 64, slip occurs between the driving and following sides of the clutch 64. Thus, the shuttle 21 is reduced in rotation speed or stopped, and waits for the reduction in tension of the wire 9. When the tension is reduced sufficiently, the shuttle 21 restores the original rotational speed and rotates accordingly. The traveling ring 11, on the other hand, rotates at a constant speed and winds the wire 9 on the core, regardless of the variations in the rotation of the shuttle 21. When a predetermined number of turns of the wire are wound, the comparator circuit 85 generates a widing-completion signal, so that the polarity-reversing circuit 88 reverses the polarity of the current to be applied to the motor 32 while at the same time opening the switch circuit 86. Accordingly, the motors 32 and 52 stop, thus stopping the traveling ring 11 and the shuttle 21. After this, the core 10 is rotated by a predetermined angle, a crossover wire is formed, and the wire 9 is fixed on the core 10. Under this condition, the switch circuit 86 is closed. The motor 32 rotates in the direction opposite to that of storage, while the motor 52 is rotated in the direction of storage. As a result, the winding operation is effected under the condition that the traveling ring 11 is rotated in the direction opposite to that of storage, while turning effort in the direction of storage is applied to the shuttle 21. If the rotational angle of the traveling ring 11 is in the range providing a slack to the wire 9 supplied from the shuttle 21, the tension of the wire 9 is zero, and therefore the clutch 64 is coupled so that the shuttle 21 is rotated in the direction of storage, thus giving to the wire 9 a tension corresponding to the sliding torque set in the clutch 64. A similar process stands in the case where the tension of the wire 9 is smaller than that corresponding to the torque set in the clutch 64. In the event that a tension larger than that corresponding to the sliding torque set in the clutch 64 is applied to the wire 9 when the wire 9 is supplied from the shuttle 21, the clutch 64 slips with the result that the shuttle 21 is pulled by the wire 9 and rotates in the direction opposite to that of storage following the traveling ring 11. In this way, the wire 9 is wound under the condition that substantially constant tension is given to the wire 9. Upon completion of the winding of a predetermined number of turns, a winding completion signal is produced from the comparator circuit 85 and applied to the polarity-reversing circuit 88 and the switch circuit 86. Therefore, the switch 86 is opened, thus stopping the traveling ring 11 and the shuttle 21. The above-mentioned process is repeated for subsequent winding operations.

Figure 9:
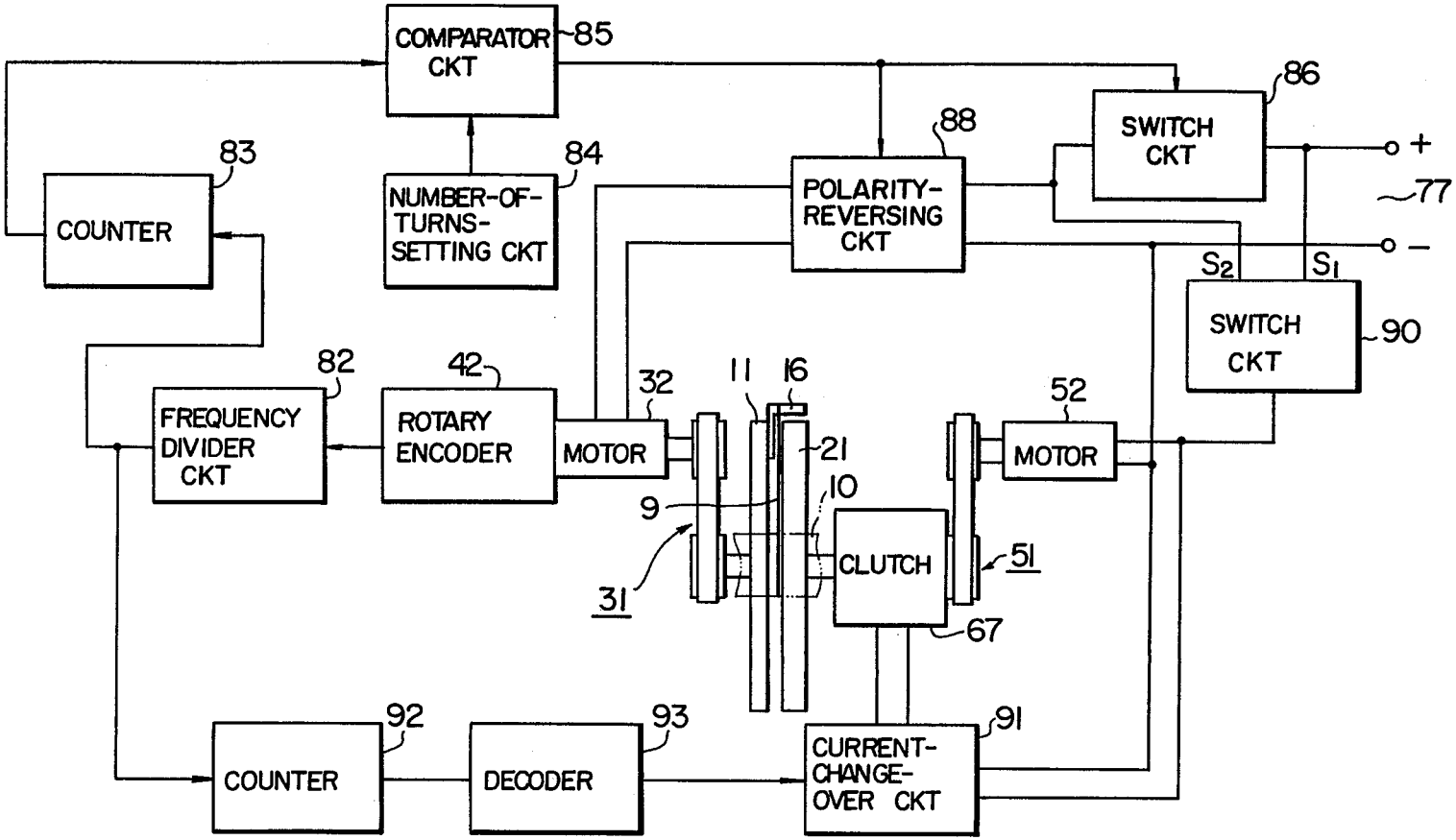
FIG. 9 is a block diagram showing a driving system of a winding machine according to a fourth embodiment of the present invention.

A fourth embodiment of the present invention is illustrated in FIG. 9. In this embodiment, the friction clutch used in the third embodiment is replaced by an electromagnetic clutch, whereby the sliding torque is changed in proportion to the amount of applied current in order that the tension of the wire 9 changing with the rotation of the traveling ring 11 may be regulated more accurately, thereby making it possible to wind the wire on the core 10 with lesser tensile stress.

In FIG. 9, the electromagnetic clutch 67 (hereinafter referred to merely as the clutch 67) is supplied with a required current from the DC power supply 77 through the switch circuit 90 and a current change-over circuit 91. A plurality of current values are set in the current change-over circuit 91 in such a manner that the required current may be applied to the clutch 67 in accordance with the rotational angle of the traveling ring 11. A counter 92 is connected to the frequency divider circuit 82 for counting the pulses, corresponding to the rotational angle of the traveling ring 11, which are generated by the rotary encoder 42 in accordance with the rotation of the motor 32 and have a predetermined number of pulses due to division of the frequency divider circuit 82. The counter 92 clears the counts thereof and restarts counting when the contents reach a value corresponding to the rotation of 360 degrees of the traveling ring. A decoder 93 is connected to the counter 92, reads the contents stored in the counter 92, applies the reading to the current change-over circuit 91, and causes the current change-over circuit 91 to apply current corresponding to the rotational angle of the traveling ring 11 to the clutch 67. The other component elements are similar to those included in the third embodiment and denoted by the same numerals as in FIG. 8.

In this arrangement, as in the preceding embodiments, the core 10 is held by the holding device, the wire is stored in the shuttle 21, an end of the wire is fixed on the core 10, and the switch circuit 90 is changed over to the side S2. Under this condition, the switch circuit 86 is closed, and the motors 32 and 52 are rotated in the direction of storage, so that the traveling ring 11 and the shuttle 21 are rotated also in the direction of storage, thereby winding the wire 9 on the core 10. In the process, the pulses generated by the rotary encoder 42 are applied through the frequency divider circuit 82 and counted by the counter 92. The contents of the counter 92 are decoded by the decoder 93, and applied to the current change-over circuit 91 as information of the rotational angle of the traveling ring 11, with the result that current corresponding to the rotational angle of the traveling ring 11 is supplied to the clutch 67. The sliding torque corresponding to the current applied is set in the clutch 67, and the revolution of the motor 52 is transmitted to the shuttle 21. Therefore, in the case where the traveling ring 11 rotates at a constant speed, the current applied to the clutch 67 is increased in proportion to the degree of slack of the wire 9 when the slack is produced so that the wire 9 is wound at a higher speed as the slack is increased, whereas the current applied to the clutch 67 is decreased in reverse proportion to the amount of the wire supplied from the shuttle 21 when the wire is reeled off the shuttle 21 so that the larger the amount of wire supplied from the shuttle 21, the smaller is the tension required to slip the clutch 67 in order that the shuttle 21 may rotate following the traveling ring 11. Upon completion of winding of the predetermined number of turns, the comparator circuit 85 generates a winding-completion signal, so that the polarity-reversing circuit 88 reverses the polarity of the current to be applied to the motor 32, while at the same time opening the switch circuit 86. After preparation for the next winding process, the switch circuit 86 is closed. The motor 32 is rotated in the direction opposite to that of storage, and the motor 52 in the direction of storage, thereby rotating the traveling ring 11 and the shuttle 21 in the direction opposite to that of storage and the direction of storage respectively. Also in this case, as already explained, the current corresponding to the rotational angle of the traveling ring 11 is applied from the current change-over circuit 91 to the clutch 67, thus adjusting the tension of the wire 9.

We claim:

1. A winding machine comprising:

a traveling ring including an opening for introducing a part of an annular member within the inside of the ring, and a guide member for guiding a wire toward said annular member, said traveling ring being rotatably supported;

a shuttle including an opening adapted to be closed and opened selectively for introducing a part of said annular member within the inside of the shuttle, and a groove for storing the wire on the outer periphery thereof, said shuttle being rotatably supported on the same axis as said traveling ring in a predetermined spaced and facing relation with said traveling ring;

first driving means for rotating said traveling ring in the direction opposite to that of storing said wire on said shuttle so that the wire stored in said shuttle is wound on said annular member in the direction opposite to that of storage, said first driving means applying a braking force to said traveling ring in response to the rotation of said traveling ring following said shuttle by the tension of said wire when said wire is wound on said annular member in the direction of storage by the rotation of said shuttle;

second driving means for rotating said shuttle in the direction of storage for storing the wire in the groove of said shuttle by rotating said shuttle in the direction of storage, and for winding on said annular member in the direction of storage said wire stored in said shuttle, said second driving means applying a braking force to said shuttle in response to the rotation of said shuttle following said traveling ring by the tension of said wire when said wire is wound on said annular member in the direction opposite to that of storage by the rotation of said traveling ring; and holding means for holding said annular member in such a manner that the part of said annular member introduced within the inside of said traveling ring and said shuttle crosses said axis common to said traveling ring and said shuttle at the winding position of said wire, said holding means rotating said annular member about the axis of said annular member in synchronism with the rotation of selected one of said traveling ring and said shuttle when said wire is wound on said annular member.

2. A winding machine comprising:

a traveling ring including an opening for introducing a part of an annular member within the inside of the ring, and a guide member for guiding a wire toward said annular member, said traveling ring being rotatably supported;

a shuttle including an opening adapted to be closed and opened selectively for introducing a part of said annular member within the inside of said shuttle, and a groove for storing said wire on the outer periphery thereof, said shuttle being rotatably supported on the same axis as said traveling ring in a predetermined spaced and facing relation with said traveling ring;

first driving means for rotating said traveling ring in the direction of storing the wire on said shuttle and in the direction opposite to that of storage, thereby winding the wire stored on said shuttle, on said annular member in the direction of storage and in the direction opposite to that of storage;

second driving means for rotating said shuttle in the direction of storage, thereby storing the wire in said groove of said shuttle, said second driving means rotating said shuttle in the direction of storage when said traveling ring rotates in the direction of storage for winding the wire on said annular member in the direction of storage, and applying a braking force to said shuttle in response to the rotation of said shuttle following said traveling ring by the tension of the wire when said traveling ring rotates in the direction opposite to that of storage for winding the wire on said annular member in the direction opposite to that of storage; and holding means for holding said annular member a part of which is introduced within the inside said traveling ring and said shuttle, said holding means rotating said annular member about the axis of said annular member in synchronism with the rotation of said traveling ring when the wire is wound on said annular member.

3. A winding machine comprising:

a traveling ring including an opening for introducing a part of an annular member within the inside of the ring, and a guide member for guiding a wire toward said annular member, said traveling ring being rotatably supported;

a shuttle including an opening adapted to be closed and opened selectively for introducing a part of said annular member within the inside of the shuttle, and a groove for storing the wire on the outer periphery thereof, said shuttle being rotatably supported on the same axis as said traveling ring in a predetermined spaced and facing relation to said traveling ring;

first driving means for rotating said traveling ring in the direction of storing the wire on said shuttle and in the direction opposite to that of storage, thereby winding the wire stored on said shuttle, on said annular member in the direction of storage and in the direction opposite to that of storage;

second driving means including a friction clutch adapted to slip under a force more than a predetermined torque, said second driving means transmitting to said shuttle a turning effort in the direction of storage corresponding to said predetermined torque set in said friction clutch, when the wire is stored in said shuttle and when the wire is wound on said annular member by the rotation of said traveling ring; and holding means for holding said annular member a part of which is introduced within the inside of said traveling ring and said shuttle, said holding means rotating said annular member about the axis of said annular member in synchronism with the rotation of said traveling ring when the wire is wound on said annular member.

4. A winding machine comprising:

a traveling ring including an opening for introducing a part of an annular member within the inside of the ring, and a guide member for guiding a wire toward said annular member, said traveling ring being rotatably supported;

a shuttle including an opening adapted to be closed and opened selectively for introducing a part of said annular member within the inside of the shuttle, and a groove for storing the wire on the outer periphery thereof, said shuttle being rotatably supported on the same axis as said traveling ring in a predetermined spaced and facing relation to said traveling ring;

first driving means for rotating said traveling ring in the direction of storing the wire on said shuttle and in the direction opposite to that of storage, thereby winding the wire stored on said shuttle, on said annular member in the direction of storage and in the direction opposite to that of storage, second driving means including an electromagnetic clutch adapted to change the magnitude of torque to be transmitted, in proportion to current applied thereto, and adapted to slip in response to a torque larger than said torque to be transmitted, said second driving means transmitting to said shuttle a turning effort of the torque in the direction of storage corresponding to the current applied to said electromagnetic clutch, when said wire is stored on said shuttle and when said wire is wound on said annular member by the rotation of said traveling ring;

an electromagnetic clutch control circuit for detecting the rotational angle of said traveling ring and applying to said electromagnetic clutch a predetermined current corresponding to the rotational angle of said traveling ring; and holding means for holding said annular member a part of which is introduced within the inside of said traveling ring and said shuttle, said holding means rotating said annular member about the axis of said annular member in synchronism with the rotation of said traveling ring when the wire is wound on said annular member.

* * * * *